US005448459A

United States Patent [19]

Rogers

[11] Patent Number: 5,448,459

[45] Date of Patent: Sep. 5, 1995

[54] CLIP-ON PENLIGHT

[76] Inventor: Clissie M. Rogers, 309 Dorchester Rd., Akron, Ohio 44320

[21] Appl. No.: 303,676

[22] Filed: Sep. 9, 1994

[51] Int. Cl.[6] ..... F21L 7/00

[52] U.S. Cl. ..... 362/191; 362/118; 362/120; 362/396; 362/421; D26/60; D26/63

[58] Field of Search ..... 362/118, 119, 120, 191, 362/396, 421, 190; D26/38, 60, 63

[56] References Cited

U.S. PATENT DOCUMENTS 3,604,917 9/1971 Schmidt ..... 240/6.46
4,047,017 9/1977 Herring ..... 362/118
4,563,728 1/1986 Bruggeman et al. ..... 362/206
4,737,894 4/1988 Kuch et al. ..... 362/118
4,799,132 1/1989 Perlsweig ..... 362/118
4,967,323 10/1990 Johnson et al. ..... 362/190 X
5,131,775 7/1992 Chen ..... 401/195
5,193,897 3/1993 Halsey ..... 362/118

*Primary Examiner*—Stephen F. Husar
*Attorney, Agent, or Firm*—Henry S. Miller; Rhodes & Ascolillo

[57] ABSTRACT

A small, self contained light, swivel mounted on a clasp that will grip cylindrically shaped objects including pens, pencil and fingers. The cone shaped light body includes a lens, reflector, bulb, battery and switch.

7 Claims, 1 Drawing Sheet

CLIP-ON PENLIGHT

BACKGROUND OF THE INVENTION

1. Field of the Invention

This invention relates generally to portable lighting device and more particularly to a lighting device that is adapted for attachment to writing instruments.

2. Description of the Prior Art

The idea of a pen lite has been in the public domain for some time. Extensive variations of the theme have been patented and marketed since batteries were small enough to fit into a tube that would fit into a shirt pocket. Pen lites have even reached the point where they are literally a pen with a built in light. For example, U.S. Pat. No. 3.604.917 issued Sep. 14, 1971 to Schmidt describes a ballpoint pen with a power and light source in the same housing with the pen. On the other hand, U.S. Pat. No. 4,563,728 issued Jan. 7, 1986 to Bruggeman et al. discloses a pen light that is a pen sized housing with two batteries and a bulb that uses the pocket clip as a switch. In the patent to Kuch et al., U.S. Pat. No. 4,737,894 issued Apr. 12, 1988 the inventors show a variation on the idea of a pen with a light by enlarging the point end to include a bulb and the butt end to include the battery. The bulb and the battery are connected by means of a wire connector. The U.S. Pat. No. 5,131,775, issued to Chen, dated Jul. 21, 1992 varies from other similar devices by using light emitting diodes around the pen point, however the batteries are in the rear end of the upper barrel member. The U.S. Pat. No. 5,193,897, issued to Halsey, on Mar. 16, 1993 is a combination pen and light pointer, where the barrel has a pen on one end and a light source on the other end. The batteries that power the light are in the end of the upper barrel member.

While the prior art seems to have a substantial supply of pen lites with and without pens, none has been found that is not an integral part of the pen. A self contained light that may by utilized with other cylindrical bodies is not known by Applicant to exist.

SUMMARY OF THE INVENTION

The invention is drawn to a small self contained light that is adapted to removable clip on a cylindrically shaped body and provide light on an area approximately four inches distant. The body of the light is elevated from the clip on a short stem and attached by a swivel connection. The apex of the cortically shaped body has the shape of a ball which engages the socket on the stem to form the connection. The base of the housing contains the lens for the light and the bulb and is threaded to the housing which contains a power supply. A switch is located on the housing for controlling the lighting function.

It is therefore an object of the invention to provide a new and improved light for pens and other uses.

It is another object of the invention to provide a new and improved light that is small and convenient to use.

It is a further object of the invention to provide a new and improved light which has all the advantages of the prior art pen lights and none of the disadvantages.

It is still another object of the invention to provide a new and improved light which may be easily and efficiently manufactured and marketed.

It is still a further object of the invention to provide a new and improved light which is susceptible of a low cost of manufacture with regard to both materials and labor, and which accordingly is then susceptible of low prices of sale to the consuming public, thereby making such board game apparatus economically available to the buying public.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF A PREFERRED EMBODIMENT

Figure 1:
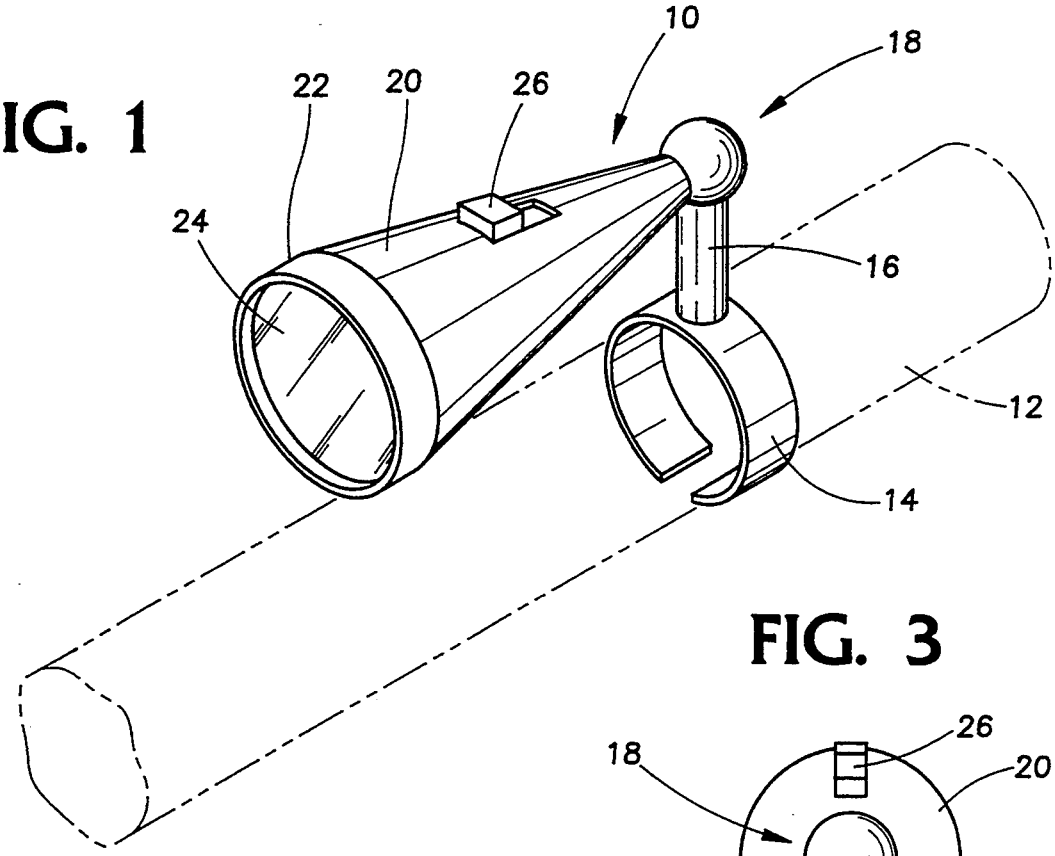
FIG. 1 is a perspective view of the invention.

Referring now to FIG. 1, the invention is shown generally at 10. In phantom is shown a cylindrically shaped object that could be a pen, pencil or even a finger. The object receives the clasp 14, which is made of a metal with some memory causing it to securely grip the object over which it is placed. Centrally located on the clasp is a stem 16 which is fixed to the clasp in a conventional manner as by welding or riveting for example. A swivel joint shown generally at 18 connects the body of the light 20 to the stem 16. The body of the light includes a base 22 including a lens 24 and an electrical switch 26.

Figure 2:
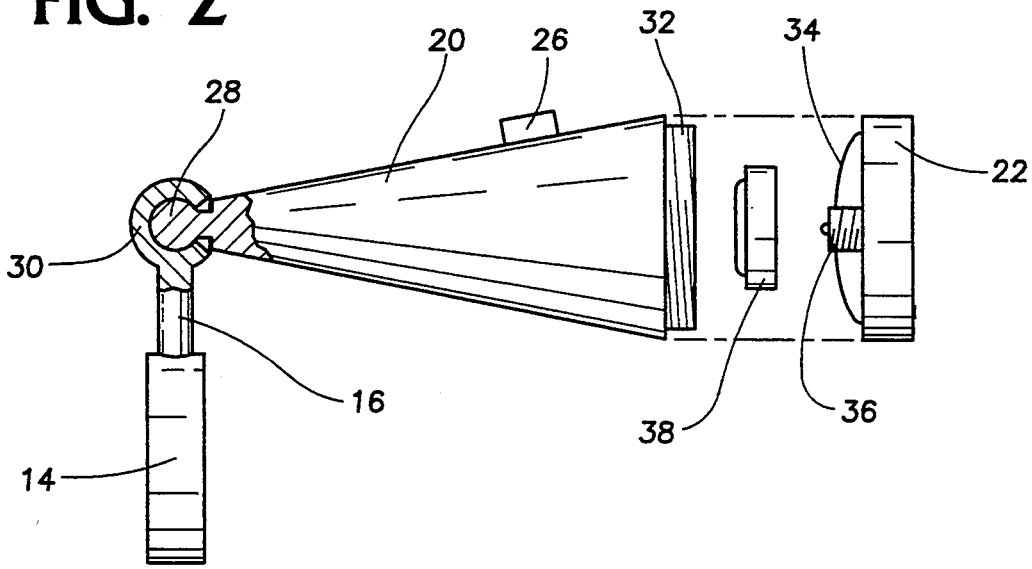
FIG. 2 is a side elevation view exploded and part in cross section of the invention.

Concerning FIG. 2, the body of the light 20 is seen to be cone shaped with the apex of the cone shaped as a sphere 28 engaged by the socket 30 thereby providing limited movement between the stem 16 and the body 20. The base of the light 22 is interiorly threaded and engages the threads 32 on the body. The base includes, beside the lens, a reflector 34 and a bulb 36. The battery 38 is secured in the body by a conventional holder for batteries of that style and connected to the bulb, through switch 26 in a conventional manner.

Figure 3:
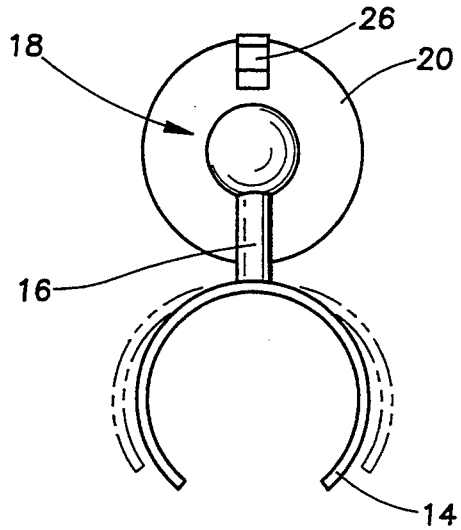
FIG. 3 is an end view of the invention.

FIG. 3 shows the end of the light including the housing 20, swivel joint 18 and stem 16. The clasp 14 is also shown in phantom to illustrate the expansion of the clasp to allow it to be placed over a cylindrically shaped object such as a pen, pencil or even a finger.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A clip on light for a cylindrically shaped structure comprising: a cone shaped body including, a bulb, a power supply in operative association with the bulb, and switch means connected between the bulb and the power supply; a clasp for gripping cylindrically shaped objects; a stem mounted on the clasp, transverse to the plane of the surface of said clasp, and a swivel joint connecting the stem and the body providing limited relative movement between the said stem and body.

2. A clip on light according to claim 1 wherein: the apex of the body is a sphere.

3. A clip on light according to claim 2 wherein: the stem includes a sphere receiving socket.

4. A clip on light according to claim 3 further including: a lens in the base of the cone shaped body.

5. A clip on light according to claim 4 wherein: the clasp is formed of a metal having a memory.

6. A clip on light for a cylindrically shaped structure comprising:

a cone shaped body comprising:

a bulb, a spherical apex;

a base on the body;

a lens in the base of the body;

a power supply in operative association with the bulb; and switch means connected between the bulb and the power supply;

a clasp, formed of a metal having a memory, for gripping cylindrically shaped objects;

a stem mounted on the clasp, transverse to the plane of the surface of said clasp;

a sphere receiving socket attached to the stem; and a swivel joint connecting the stem and the body providing limited relative movement between the said stem and body.

7. A clip on light according to claim 6 wherein: the power supply is a battery.

* * * * *